US011873608B2

(12) United States Patent
Renner

(10) Patent No.: US 11,873,608 B2
(45) Date of Patent: Jan. 16, 2024

(54) SLIPFORM CONCRETE PAVING MACHINE HAVING DOWEL BAR INSERTER MECHANISM WITH CONTINUOUS FLOOR

(71) Applicant: Power Curbers Companies, LLC, Salisbury, NC (US)

(72) Inventor: Nathaniel Ford Renner, Waverly, IA (US)

(73) Assignee: Power Curbers Companies, LLC, Salisbury, NC (US)

( * ) Notice: Subject to any disclaimer, the term of this patent is extended or adjusted under 35 U.S.C. 154(b) by 101 days.

(21) Appl. No.: 17/354,677

(22) Filed: Jun. 22, 2021

(65) Prior Publication Data

US 2021/0395960 A1 Dec. 23, 2021

Related U.S. Application Data

(60) Provisional application No. 63/043,043, filed on Jun. 23, 2020.

(51) Int. Cl.
*E01C 23/04* (2006.01)
*E01C 11/14* (2006.01)

(52) U.S. Cl.
CPC ..... *E01C 23/04* (2013.01); *E01C 11/14* (2013.01)

(58) Field of Classification Search
CPC ..... E01C 23/04; E01C 11/14
See application file for complete search history.

(56) References Cited

U.S. PATENT DOCUMENTS

| | | | | |
|---|---|---|---|---|
| 4,493,584 | A * | 1/1985 | Guntert | E01C 23/04 404/100 |
| 5,209,602 | A * | 5/1993 | Godbersen | E01C 23/04 404/88 |
| 5,588,776 | A * | 12/1996 | Swisher, Jr. | E01C 23/04 404/101 |
| 6,176,643 | B1 * | 1/2001 | Guntert, Jr. | E01C 23/04 404/100 |
| 6,390,727 | B1 * | 5/2002 | Guntert, Jr. | E01C 23/04 404/96 |
| 6,655,869 | B1 * | 12/2003 | Deeb | E01C 23/04 404/100 |
| 7,037,035 | B2 * | 5/2006 | Casters | E01C 23/04 404/100 |
| 10,738,421 | B2 * | 8/2020 | Guntert, Jr. | E01C 19/4873 |
| 11,193,244 | B2 * | 12/2021 | Guntert, Jr. | E01C 19/4873 |

(Continued)

*Primary Examiner* — Abigail A Risic
(74) *Attorney, Agent, or Firm* — Nelson Mullins Riley & Scarborough LLP

(57) ABSTRACT

A device for inserting dowel bars, the device having at least one floor plate, and the at least one floor plate defines a slot. One or more bar holders are provided, and the one or more bar holders are positioned above the slot defined within the at least one floor plate. The one or more bar holders are capable of holding a dowel bar, but the one or more bar holders are capable of allowing the dowel bar to move through the slot defined within the at least one floor plate when the dowel bar is pushed. The device has at least one fork movable longitudinally with respect to the at least one floor plate. Additionally, the device moves in a forward direction over a newly formed concrete slab, and the fork is capable of being lowered to push a dowel bar downward into the newly formed concrete slab.

15 Claims, 12 Drawing Sheets

(56) References Cited

U.S. PATENT DOCUMENTS

| | | | | |
|---|---|---|---|---|
| 2001/0041094 | A1* | 11/2001 | Guntert, Jr. | E01C 23/04 404/105 |
| 2006/0228178 | A1* | 10/2006 | Casters | E01C 23/04 404/100 |
| 2011/0058899 | A1* | 3/2011 | Francis | E01C 23/04 404/88 |
| 2019/0203428 | A1* | 7/2019 | Guntert, Jr. | E01C 11/14 |
| 2021/0025118 | A1* | 1/2021 | Guntert, Jr. | E01C 19/4873 |

* cited by examiner

SLIPFORM CONCRETE PAVING MACHINE HAVING DOWEL BAR INSERTER MECHANISM WITH CONTINUOUS FLOOR

CROSS-REFERENCE TO RELATED APPLICATIONS

This application claims priority from U.S. provisional patent application Ser. No. 63/043,043, filed on Jun. 23, 2020, in the United States Patent and Trademark Office. The disclosures of which is incorporated herein by reference in its entireties.

FIELD OF THE INVENTION

The present invention generally relates to a slipform paving machine having an improved concrete dowel bar inserter mechanism.

BACKGROUND OF THE INVENTION

Slipform paving machines may include dowel bar inserter mechanisms for inserting a dowel bar into a newly formed concrete slab, and various methods exist for inserting the dowel bar into the concrete slab. One method for the insertion of dowel bars uses baskets, placed in front of a slipform paving machine, that hold the dowel bars before the concrete is placed. The slipform paving machine then passes over the dowel bars, forming the slab around them. Additional labor is required to setup and secure the baskets to the subgrade. Additionally, users are often required to stop the slipform paving machine in order to setup and secure the baskets and dowels. Stopping the forward movement of the slipform paving machine often causes delays in completing the process of inserting the dowel bars and completing the paving process, and stopping at a certain position may create an undesired disturbance or deformity across the width of the freshly formed concrete slab. Furthermore, because the use of such a basket often requires a user to manually input the dowel bars, devices using such a basket are prone to human error and require a user to spend a significant amount of time manually inputting the bars.

Other paving machines include dowel bar inserter mechanisms without any floor contacting the freshly formed concrete slab near the area where dowel bars are being inserted. Because no such floor is included, the insertion of dowel bars will typically create undesired deformities within the concrete slab, creating depressions at the top surface above dowel bars and creating elevations at other points on the top surface.

Other paving machines are required to stop the forward movement of the dowel bar mechanism in order to insert dowel bars into the freshly formed concrete slab. A floor to consolidate the disturbed concrete is released as the paving machine moves forward and is then moved forward itself when the next batch of dowel bars is to be inserted. The resetting and moving forward of the floor also creates a disturbance. Stopping the forward movement of the dowel bar mechanism causes delays in completing the process of inserting the dowel bars and completing the paving process.

Additionally, various methods of inserting dowel bars are shown in U.S. Pat. Nos. 5,941,659 and 9,359,726. These patents are incorporated by reference in their entirety for all purposes.

Thus, there is a need for a novel dowel bar inserter mechanism.

SUMMARY OF THE INVENTION

Embodiments of the present invention recognize and address the foregoing considerations, and others, of prior art construction and methods.

One aspect of certain embodiments of the present invention provides a slipform paving machine comprising a device for inserting dowel bars. The device comprises at least one floor plate, and the at least one floor plate defines a slot. One or more bar holders are provided, and the one or more bar holders are positioned above the slot defined within the at least one floor plate. The one or more bar holders are capable of holding a dowel bar, but the one or more bar holders are capable of allowing the dowel bar to move through the slot defined within the at least one floor plate when the dowel bar is pushed. The device comprises at least one fork movable longitudinally with respect to the at least one floor plate. Additionally, the device moves in a forward direction over a newly formed concrete slab, and the fork is capable of being lowered to push a dowel bar downward into the newly formed concrete slab.

Further areas of applicability of the present invention will become apparent from the detailed description provided hereinafter. It should be understood that the detailed description and specific examples, while indicating the preferred embodiments of the invention, are intended for purposes of illustration only and are not intended to limit the scope of the invention.

BRIEF DESCRIPTION OF THE DRAWINGS

The present invention will become more fully understood from the detailed description and the accompanying drawings, which are not necessarily to scale, wherein.

DESCRIPTION OF THE PREFERRED EMBODIMENTS

Figure 1:
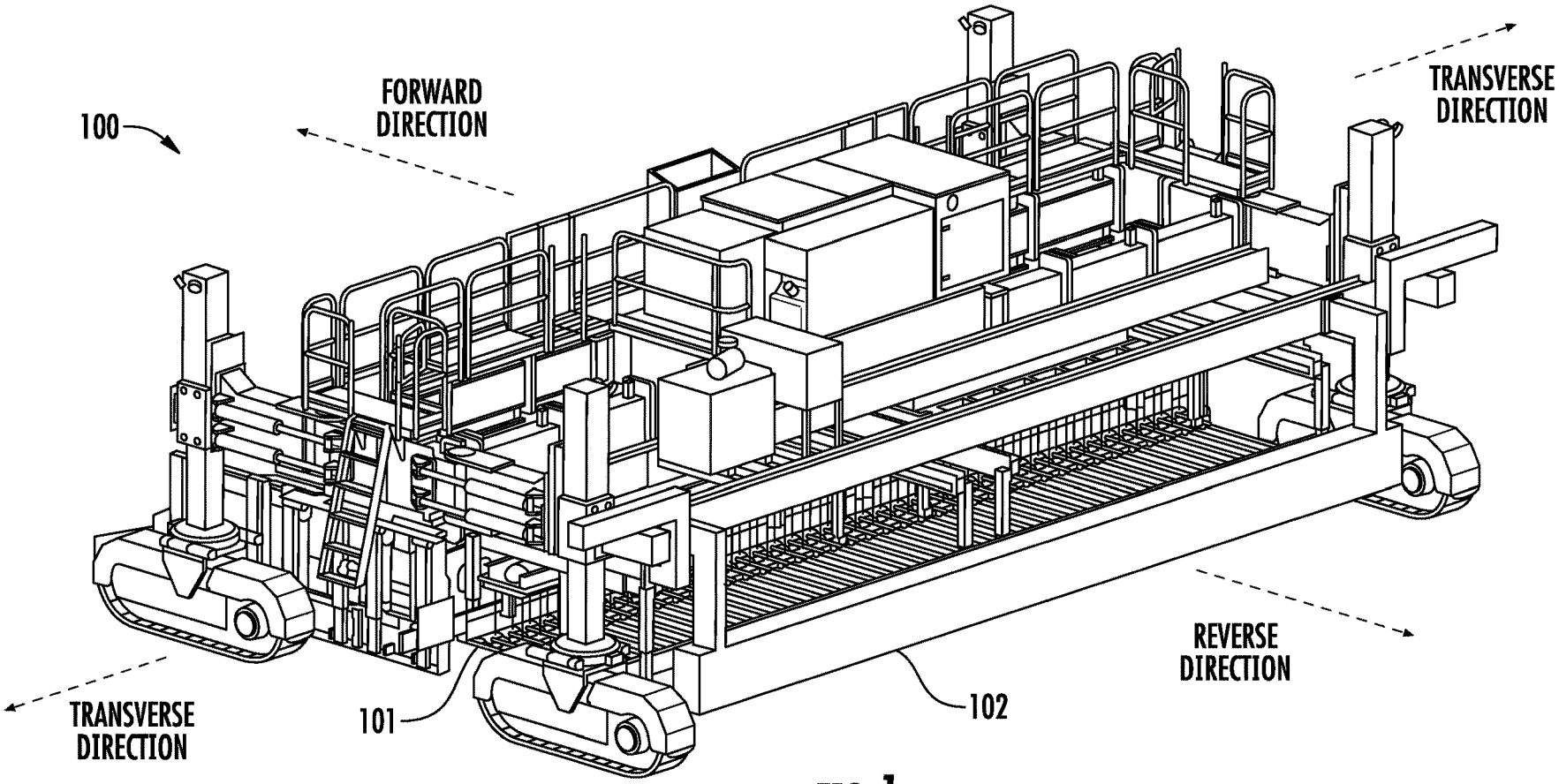
FIG. 1 is an isometric view of a slipform paving machine with a dowel bar inserter mechanism in accordance with an embodiment of the present invention.

The following description of the embodiments of the present invention is merely exemplary in nature and is in no way intended to limit the invention, its application, or uses. The following description is provided herein solely by way of example for purposes of providing an enabling disclosure of the invention but does not limit the scope or substance of the invention.

Embodiments of the present invention generally relate to an improved concrete dowel bar inserter mechanism. These embodiments permit the dowel bar inserter mechanism and the paving machine to both move forward continuously without repeatedly stopping that forward movement to insert dowel bars.

In an embodiment of the improved concrete dowel bar inserter mechanism, the mechanism moves continuously across the newly poured concrete. By moving forward continuously, the mechanism does not stop at a certain location on the newly poured concrete. This helps to avoid the creation of any undesired disturbance across the width of the freshly formed concrete slab. Several aspects of the embodiments allow for this improvement, including but not limited to the use of a carrier that is allowed to remain stationary relative to the slab while the paving machine moves forward. The carrier may be connected to forks which engage dowel bars and drive them downwards into a newly formed concrete slab.

In an embodiment of the improved concrete dowel bar inserter mechanism, the mechanism comprises a loading cart that holds one or more dowel bars. The loading cart may travel transversely across the mechanism to place one or more dowel bars on one or more bar holders. The loading cart may place the dowel bars in bar holders without any additional human labor required, and the mechanism may continue its forward movement across the newly poured concrete while the loading cart is actively placing the one or more dowel bars onto the one or more bar holders. The inclusion of such a loading cart minimizes the risk of human error, and it also allows for the mechanism to operate more efficiently. Additionally, since the mechanism may continue its forward movement across the newly poured concrete while the loading cart is actively placing the one or more dowel bars onto the one or more bar holders, users may again avoid creating an undesired disturbance across the width of the freshly formed concrete slab.

In an embodiment, the dowel bar inserter mechanism comprises one or more floor plates which may remain in contact with the newly poured concrete. These floor plates may come into contact with the newly formed concrete surface to help maintain an even top surface of the concrete slab without creating undesired disturbances across the width of the slab. As dowel bars are inserted in spacing between floor plates, the floor plates will help prevent the creation of unwanted elevations on the top surface of the concrete slab. The floor plates may be relatively rigid, preventing the floor plates from flexing in a way that would cause the floor plates to float above unwanted elevations.

An oscillating correcting beam may travel over the top surface of the newly formed concrete slab after the dowel bars have been inserted. The oscillating correcting beam may be relatively rigid, preventing the oscillating correcting beam from flexing in a way that would cause the oscillating correcting beam to float above unwanted elevations. By using the floor plates and the oscillating correcting beam, the top surface of the newly formed concrete slab can maintain a more even shape.

FIG. 1 is an isometric view of a concrete slipform paving machine 100 having a dowel bar inserter mechanism ("DBI") 101 in accordance with the present invention. The DBI 101 will be shown in greater detail in the subsequent figures. The paving machine 100 may create a newly formed concrete slab by pouring concrete, and the DBI 101 may be positioned towards the rear of the paving machine 100 (e.g., between forward and rearward sets of tracks) so that, as the paving machine 100 moves in the forward direction, the DBI 101 may pass over the newly formed concrete slab after the concrete has been poured.

As shown in FIG. 1, the paving machine may also comprise an oscillating correcting beam ("OCB") 102. This OCB 102 may be positioned behind the DBI 101 so that, as the paving machine 100 moves in the forward direction, the OCB 102 passes over the newly formed concrete slab after the DBI 101 has inserted dowel bars into the concrete slab. The OCB 102 may assist in smoothening the surface of the concrete slab and reducing the presence of unwanted elevations and depressions within the surface. The OCB 102 is preferably rigid so that it will not flex up or float above unwanted elevations, but will move continuously side to side in the transverse direction to smooth unwanted elevations. While the DBI 101 and the OCB 102 are described as separate components, the OCB 102 may be considered to be a component of the DBI 101 in some embodiments.

Figure 2:
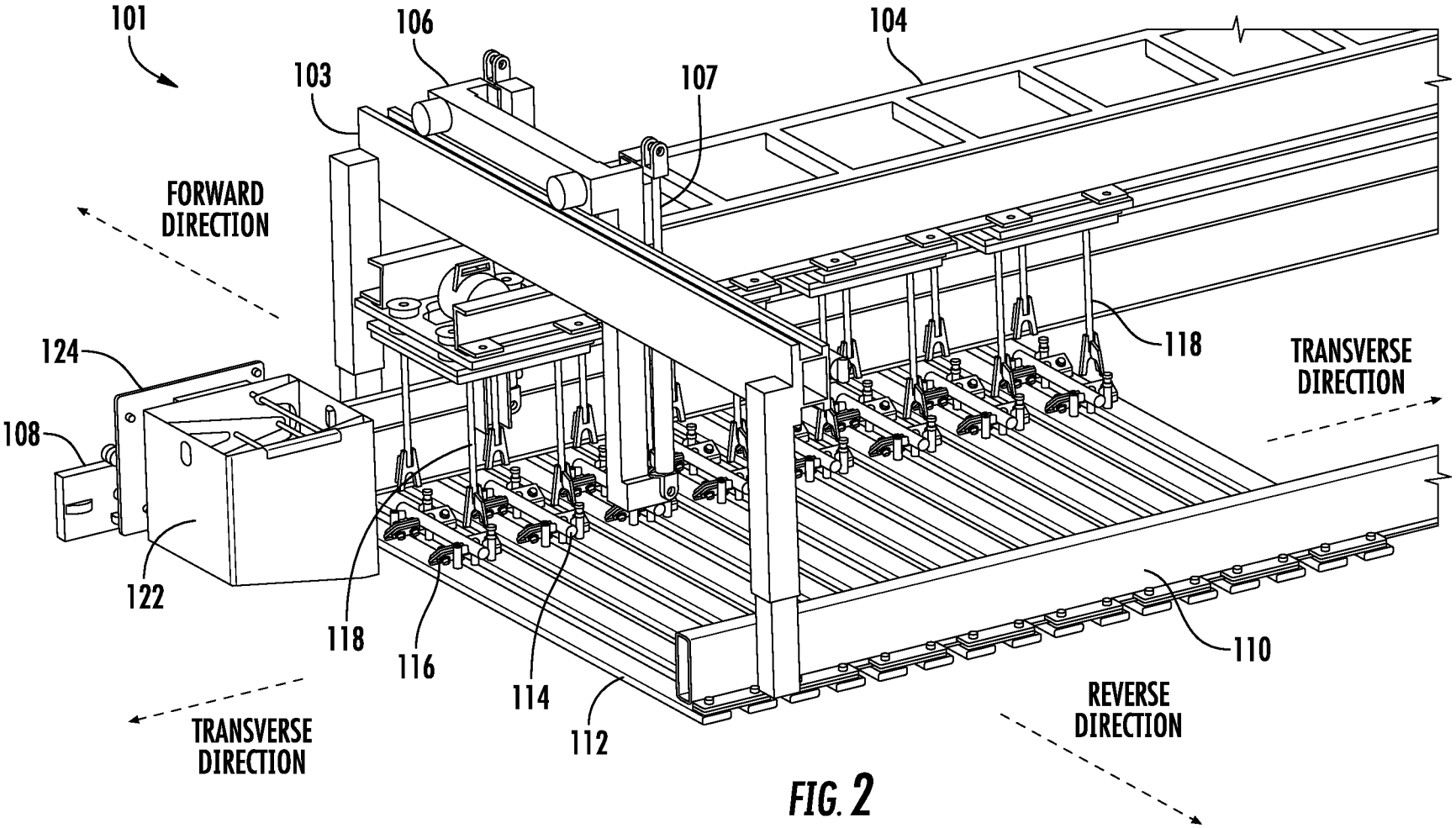
FIG. 2 is an isometric view of a dowel bar inserter mechanism that may be used with the slipform paving machine of FIG. 1 in accordance with an embodiment of the present invention.

FIG. 2 shows an isometric view of an embodiment of DBI 101. The DBI 101 may comprise a longitudinal carrier rail 103 at each lateral end of the DBI 101. While only one carrier rail 103 is shown in FIG. 2, the DBI 101 may also comprise another carrier rail on the other end of the DBI 101, and additional carrier rails may be used at intermittent positions in the transverse direction. The DBI 101 may also comprise a beam 104, and this beam 104 may span transversely across the DBI 101. The DBI 101 may also comprise a carrier 106.

Figure 7:
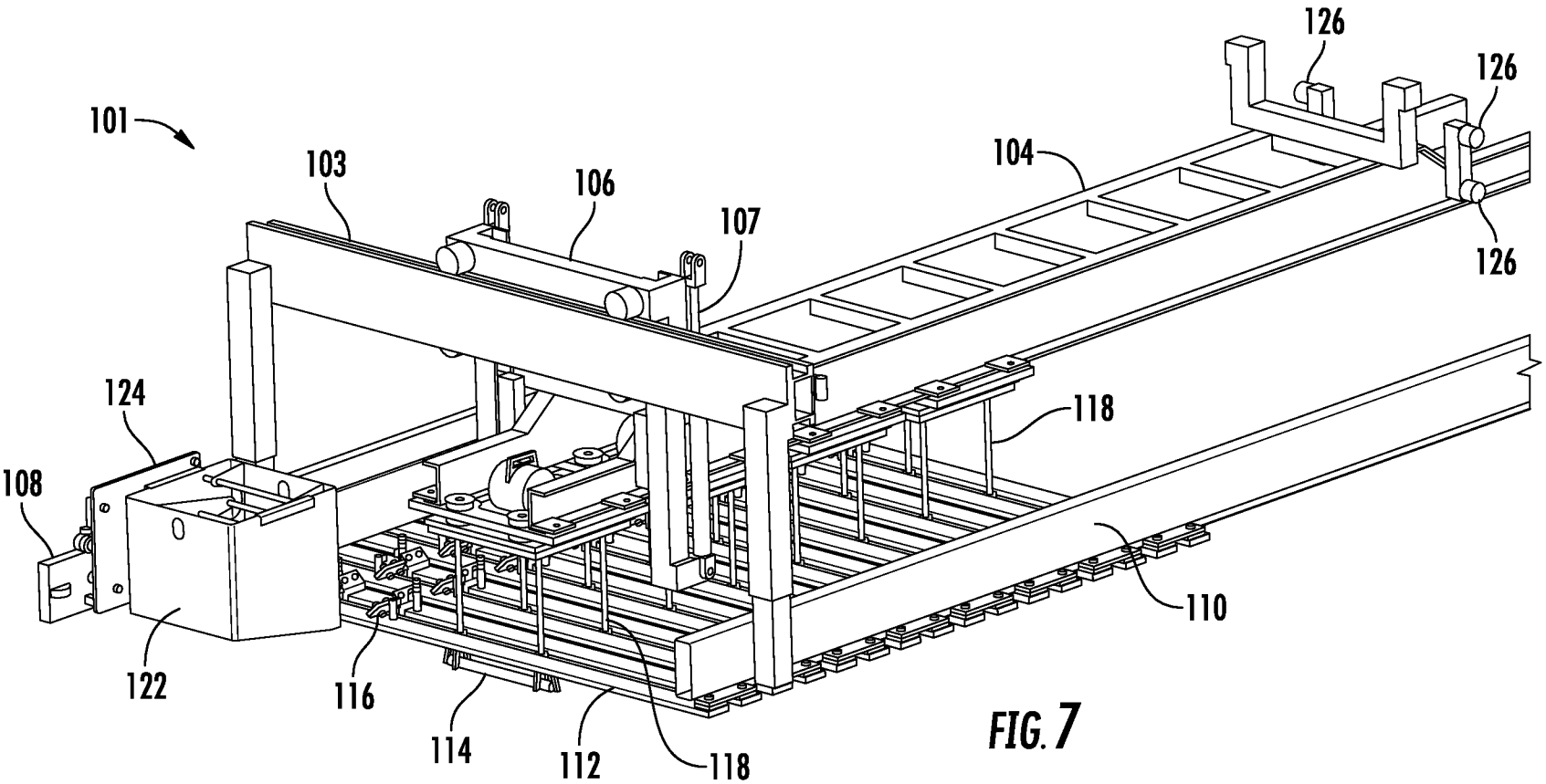
FIG. 7 is an isometric view of the dowel bar inserter mechanism of FIG. 2 where forks are pushing the dowel bars downward in the concrete towards their resting position.
Figure 9:
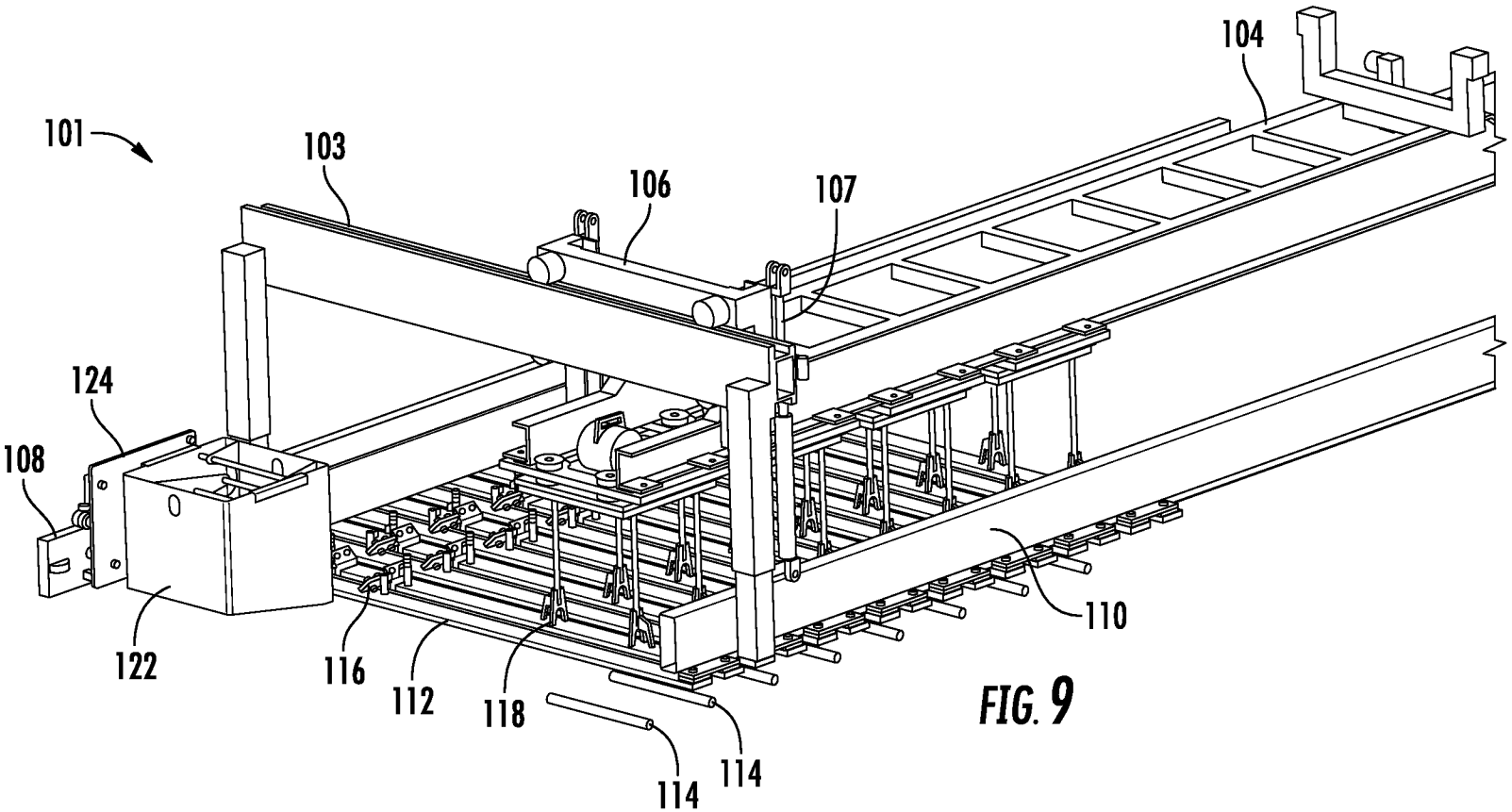
FIG. 9 is an isometric view of the dowel bar inserter mechanism of FIG. 2 where forks are raised from the dowel bars.

As shown in FIG. 2, the beam 104 may be connected to the carrier 106, and the carrier 106 may move along the carrier rail 103 in the forward and reverse directions. As shown in FIG. 2, the carrier 106 is resting in a forward position, but the carrier 106 may move along the carrier rail 103 to a rearward position as shown in FIG. 9. The beam 104 is physically connected to the carrier 106 so that the movement of the beam 104 is constrained relative to the carrier 106 in the forward, reverse, and transverse directions. However, the beam 104 may be raised and lowered relative to the carrier 106. For example, one or more hydraulic cylinders 107 may be used to raise and lower the beam 104 relative to the carrier 106, with a first end of the hydraulic cylinder 107 connected to the carrier 106 and a second end of the hydraulic cylinder 107 connected to the beam 104. This physical connection between the beam 104 and the carrier 106 may also be accomplished through the use of a slider mechanism, but a person of ordinary skill in the art would appreciate that this connection may be accomplished in a variety of ways. As can be best seen in FIG. 7, the beam 104 may comprise one or more rollers 126. The carrier 106 may comprise a track running in a vertical direction that defines a recess where the one or more rollers 126 of the beam 104 may be received. For the purposes of illustration, FIG. 7 shows the rollers 126 being freely exposed without any carrier 106 on that upper right portion of the figure. On the lower left portion of FIG. 7, four rollers 126 are disposed within the recesses defined by the track of the carrier 106.

The DBI 101 may comprise a front railing 108 and a back railing 110. The front railing 108 and back railing 110 may be physically connected to the two carrier rails 103 as shown in FIG. 2. One or more floor plates 112 may also be physically connected to the front railing 108 and the back railing 110. Where a plurality of floor plates 112 are used, the floor plates 112 may be distributed to define a spacing between the floor plates 112. This spacing should be large enough to permit the dowel bars 114 to be lowered through the spacing. However, the spacing will preferably be small to provide increased contact by the floor plates 112 with the top surface of the newly formed concrete slab. Dowel bars may commonly have a 1.25-inch diameter, so the spacing will preferably be slightly larger than this to allow for the dowel bars 114 and forks 118 to fit through the spacing. In an alternative embodiment, a single floor plate may be used, and this floor plate may define slots through which the dowel bars may be dropped to the surface of the newly formed concrete slab. In this context, the term "slots" and "spacing" shall each be construed to mean an open area which allows the forks and dowel bar to pass through.

Floor plates 112 assist in maintaining a relatively even surface for the concrete slab. Without any floor plates 112, the insertion of dowel bars 114 can result in unwanted depressions and/or elevations in the concrete slab. By utilizing floor plates 112, the floor plates 112 may maintain contact with the surface of the concrete slab, preventing unwanted depressions and/or elevations from developing at the intermittent areas, and the insertion of dowel bars 114 into the newly formed concrete slab will distribute the displaced concrete within the concrete slab just above the area where depressions might otherwise form. The floor plates 112 will reflect or contain the vibration of the concrete that is created by vibrating the dowel bars 114 as they are inserted into the concrete, and this may help prevent the surface of the concrete slab from rising up in the intermittent areas that would otherwise create unwanted elevations.

In some alternative embodiments, the floor plates 112 may be elevated slightly above the concrete slab. By raising the floor plates 112 slightly, the insertion of the dowel bars 114 will displace some of the concrete into intermittent areas until the concrete surface rises up to the floor plates 112. Once the concrete surface rises up to the floor plates 112, the displaced concrete will then rise up only in the other areas above the dowel bars 114 where no floor plates are present. If the volume of the dowel bar 114 being inserted and the surface area of the concrete is known, then an appropriate elevation of the floor plates 112 can be determined.

The front railing 108, back railing 110, floor plates 112, and the carrier rail 103 each remain in a fixed position with respect to the paving machine 100. Accordingly, as the paving machine 100 moves forward some distance, the aforementioned elements also move forward at the same pace.

The DBI 101 may comprise one or more bar holders 116. These bar holders 116 may be disposed above and physically connected to one or more floor plates 112. The DBI 101 may also comprise a loading cart 122. This loading cart 122 may serve as a hopper where one or more dowel bars may be held. As will be discussed in greater detail below, the loading cart 122 may travel transversely across the DBI 101 to position dowel bars 114 on the bar holders 116. This process may be repeated as dowel bars 114 are inserted and the DBI 101 begins a new cycle. In the embodiment shown in the figures, the dowel bars 114 are positioned so that they rest on the bar holders 116 above the spacing between the floor plates 112. However, the dowel bars 114 may be positioned differently in other embodiments.

Figure 3:
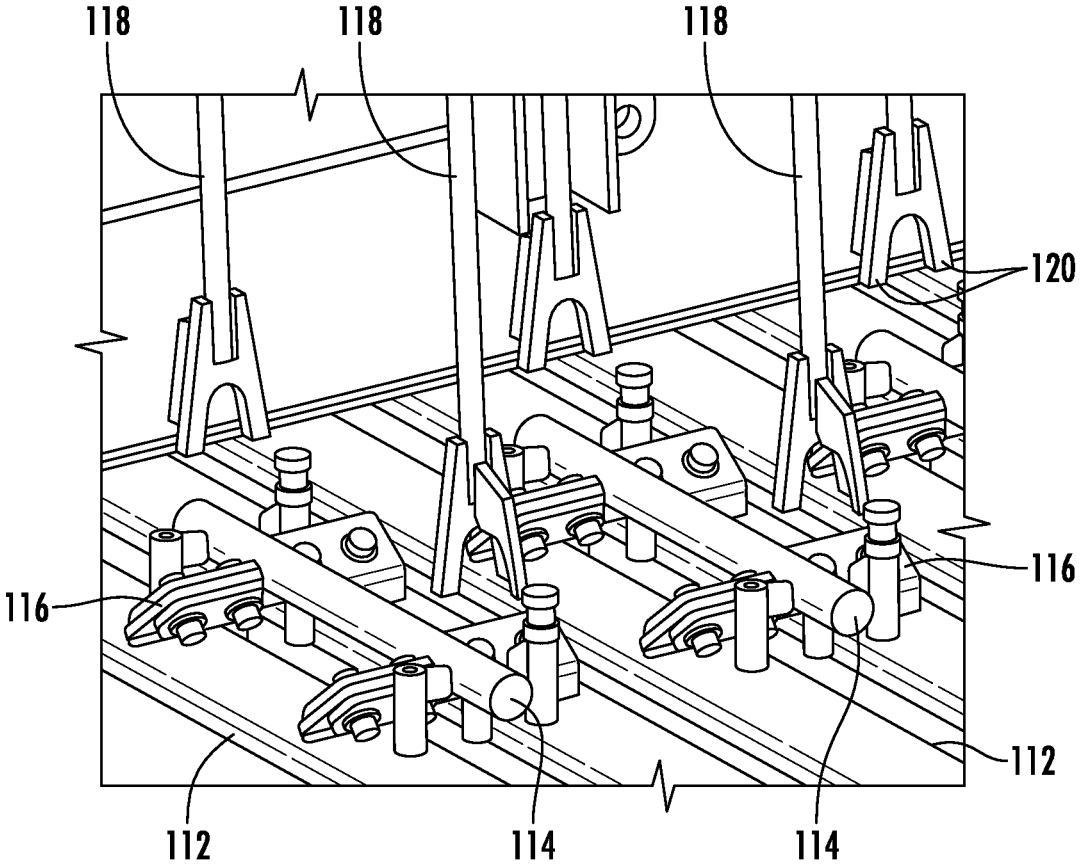
FIG. 3 is an enlarged view of the dowel bar inserter mechanism of FIG. 2 where dowel bars resting on bar holders may be more clearly seen.

Forks 118 may be physically connected to the beam 104, and the forks 118 may extend downwardly from the beam 104. The forks 118 may comprise prongs 120 that come into contact with the dowel bars 114. These prongs 120 can be seen in FIG. 2, and they may be seen more clearly in FIG. 3, which is an enhanced view of the embodiment. The forks 118 may be lowered down so that the prongs 120 of the forks 118 rest at the appropriate height in relation to the dowel bars 114. The prongs 120 may then engage with the dowel bar 114 to secure the dowel bar 114 as the forks 118 are being pushed downward. The forks 118 may be arranged in forward and aft pairs, with one such pair pushing on forward and rearward portions of a respective dowel bar 114. Alternatively, embodiments are contemplated in which there are three or four forks per dowel 114. In an embodiment, the DBI 101 may cause vibration (via a vibrator mounted with respect to beam 104) at the forks 118. This vibration may allow the dowel bar 114 to be more easily inserted into the newly formed concrete slab.

Figure 4:
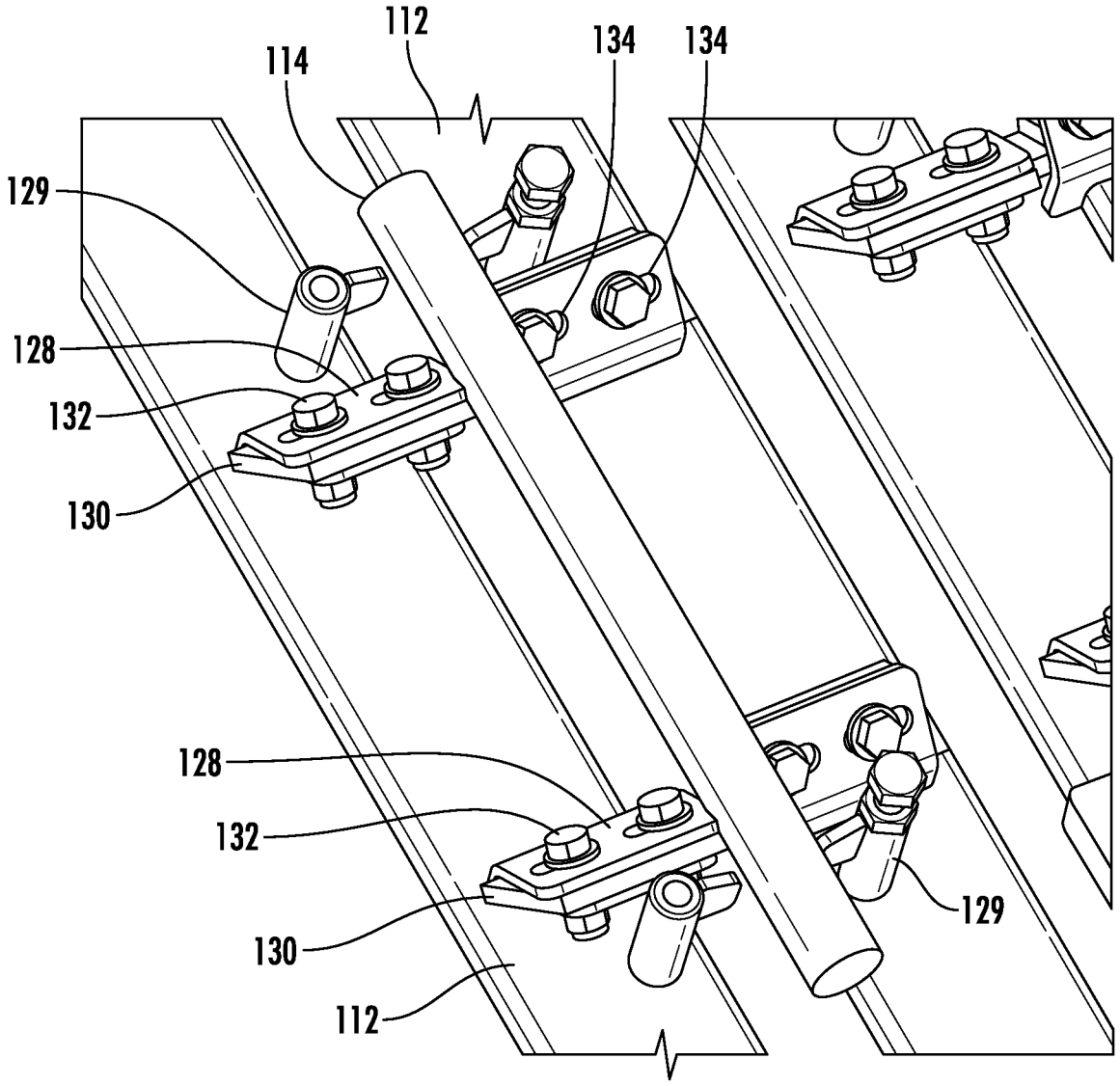
FIG. 4 is an enlarged, top perspective view of the dowel bar inserter mechanism of FIG. 2 where the dowel bars resting on the bar holders may be more clearly seen.

FIG. 4 shows the bar holders 116 in greater detail. The bar holders 116 may comprise an angled bracket 128, a guide 129, a resilient member 130, and a screw 132. The angled bracket 128 may be fixed to one or more floor plates 112. In this embodiment, the angled bracket 128 is positioned so that it will not interfere with the downward motion of the dowel bar 114. The angled bracket 128 may comprise one or more recesses that define one or more tracks 134 where a screw 132 may be received. The guide 129 may also be fixed to one or more floor plates. The guide 129 may assist in properly positioning the dowel bar 114 when the dowel bar 114 is released from the loading cart 122.

Figure 5:
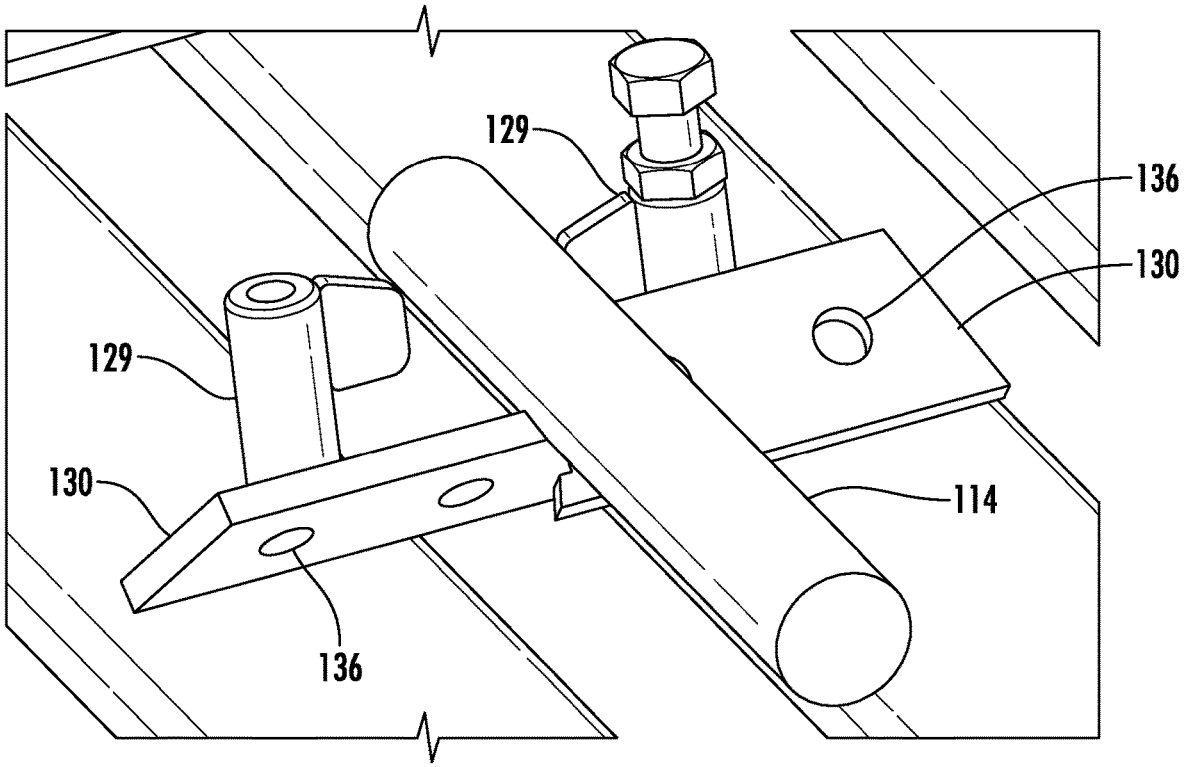
FIG. 5 is an enlarged view of a dowel bar inserter mechanism of FIG. 2 where an angled bracket of the bar holder is hidden and where a resilient member of a bar holder may be more clearly seen.
Figure 6:
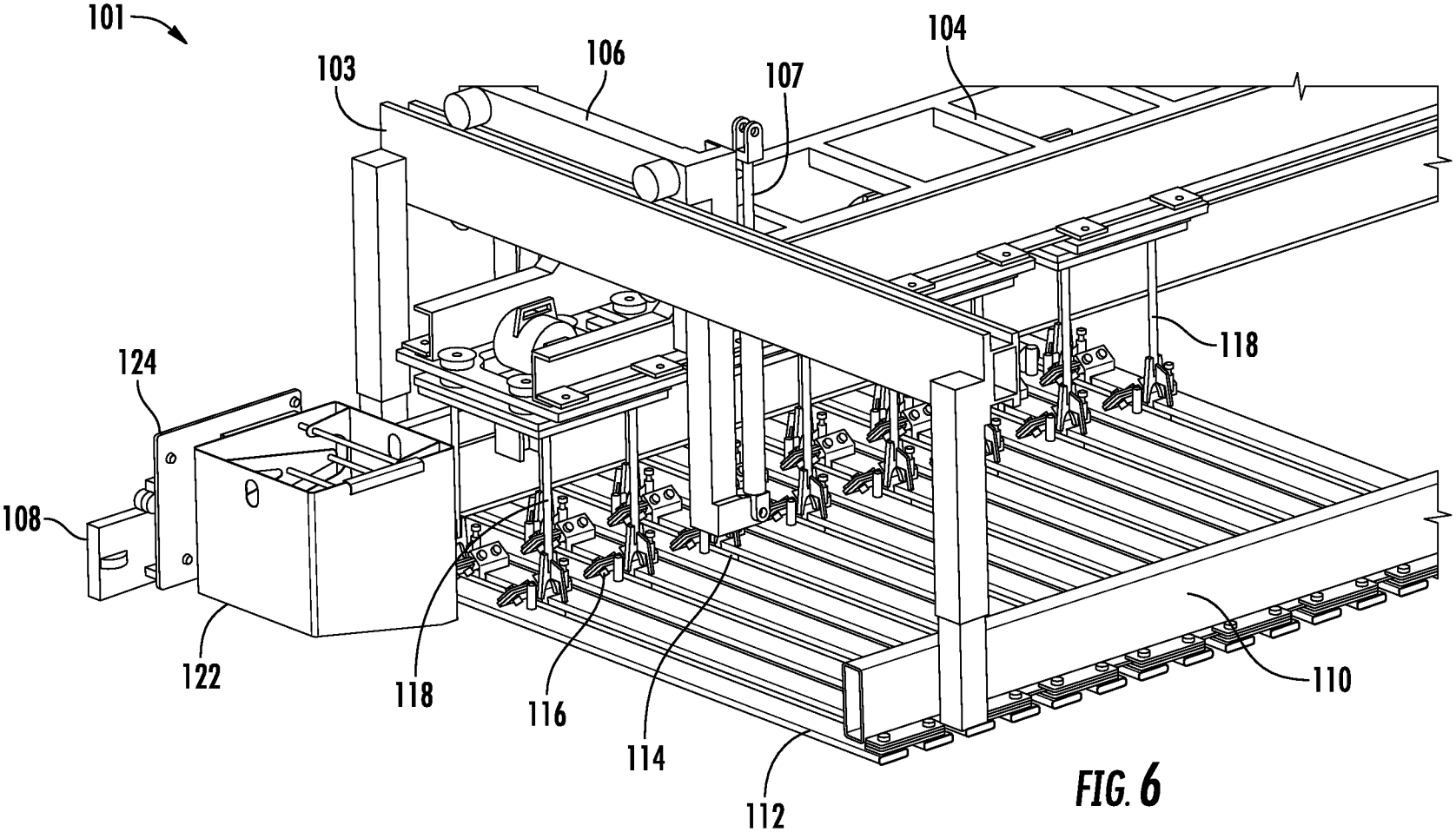
FIG. 6 is an isometric view of the dowel bar inserter mechanism of FIG. 2 where forks have pushed the dowel bars downward until they are resting on a concrete surface.

The resilient member 130 may possess a trapezoidal shape as can be best seen in FIG. 5, and this resilient member 130 may have a short top surface and a long bottom surface that are parallel. The resilient member 130 may also have two diagonal side surfaces. The resilient member may also comprise one or more recesses that define one or more holes 136 where a screw 132 or some other member may be received. The resilient member 130 may be fixed to the angled bracket 128 in a desired position by securing one or more screws through the hole 136 within resilient member 130 and the track 134 within the angled bracket 128. The natural resting state of the resilient member 130 should interfere with the downward motion of the dowel bar 114. Thus, when multiple resilient members 130 are used together, a dowel bar 114 may rest on the resilient members 130. However, upon the application of downward force on the dowel bar 114 by forks 118, the dowel bar 114 will in turn apply a force on the resilient member 130, causing distortion of the resilient member's shape. After the dowel bar 114 is pushed down a certain amount, the resilient members 130 will be distorted enough to permit the dowel bar 114 to drop down so that it rests on the newly formed concrete surface. In an alternative embodiment, a sliding or rotating member may be used in place of a resilient member 130, and springs or other similar mechanisms may be used in conjunction with the sliding or rotating member to cause it to shift and then return to its resting position after a dowel bar 114 drops to the surface of the concrete slab. Alternatively, a spring may be utilized by itself in place of resilient member 130, and one of skill in the art would appreciate that other alternatives could also be utilized in place of resilient member 130.

As the paving machine 100 and the DBI 101 move forward, the forks 118, beam 104, and the carrier 106 may remain in the same position. Accordingly, these components may move from the forward position shown in FIG. 2 to the rearward position in FIG. 9 as the velocity of these components in the forward direction is less than the velocity in the forward direction for the other components that remain fixed relative to the paving machine 100.

In the depicted embodiment, the DBI 101 moves in the forward direction indicated in FIG. 2. FIG. 2 and FIGS. 6-11 show the DBI 101 as it moves through a cycle. The cycle may begin at different stages, but the stage depicted in FIG. 2 is shown as the initial stage for the purposes of discussion herein. At the second stage depicted in FIG. 6, the beam 104 and the forks 118 are both lowered with the prongs 120 (see FIG. 3) of the forks 118 engaging end portions of the respective dowel bars 114. In this embodiment, the dowel bars 114 are pushed downward through the bar holders 116 and into the slots provided between the floor plates 112. Once the dowel bars 114 have been pushed through the bar holders 116, the dowel bars 114 will rest on the top surface of the newly formed concrete slab. Before the dowel bars 114 are pushed through the bar holders 116, the carrier 106 may remain in a locked state so that it will not slide along the carrier rail 103 and will instead remain in the same position above the bar holders 116.

Referring now to FIG. 7, after dowel bars 114 are lowered to come into contact with the concrete surface, the third stage of the insertion cycle begins. At this stage, beam 104 continues being lowered, pushing the dowel bars 114 lower into the concrete slab. Furthermore, during this third stage, the carrier 106 is in an unlocked state. As one skilled in the art will appreciate, the carrier 106 must be powered in the rearward direction or an anchor must be dropped to maintain the correct position as the paving machine moves forward. As a result, the carrier 106, the beam 104, the forks 118, and the dowel bars 114 will have minimal movement in the forward direction. The dowel bars 114 will be in the process of being pushed down further into the newly formed concrete. Because the forks 118 are engaged with the dowel bars 114 at this stage, the forks 118, the beam 104, and the carrier 106 should each stay in the generally the same position as the dowel bars 114 in the forward direction. Since other components such as the floor plates 112, the front railing 108, the back railing 110, and the carrier rail 103 continue to move forward with the paving machine 100, the forks 118, the beam 104, and the carrier 106 appear to slowly move towards the back railing 110. Thus, the relative velocity of the forks 118, the beam 104, and the carrier 106 is approximately equal and opposite of the velocity of the forward moving paving machine 100.

Figure 8:
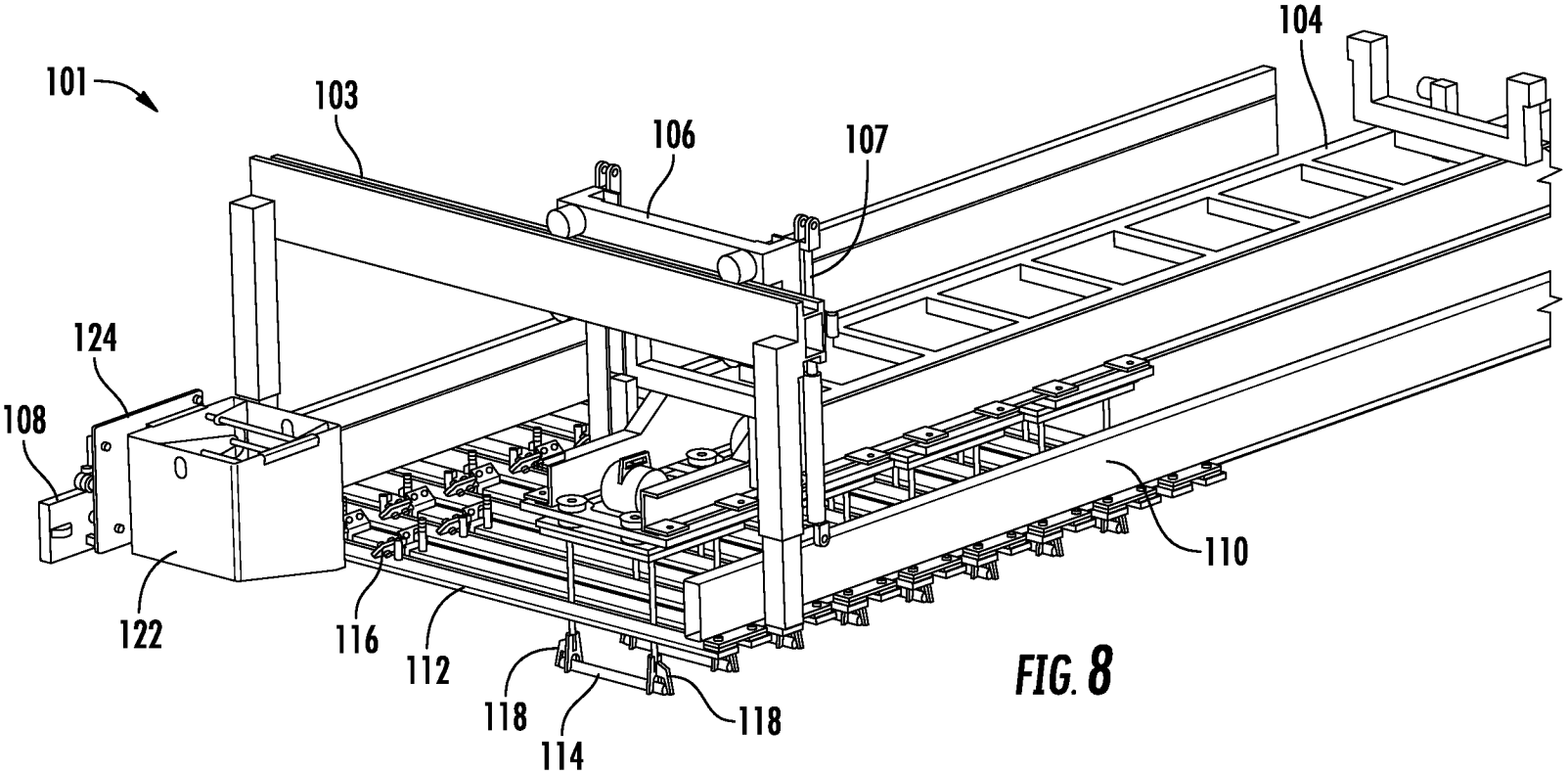
FIG. 8 is an isometric view of the dowel bar inserter mechanism of FIG. 2 where forks have finished pushing the dowel bars downward in the concrete towards their resting position.

FIG. 8 shows the DBI 101 at the completion of the third stage. At this point, the dowel bars 114 have been lowered to their designated depth within the concrete. As the dowel bars 114 are pushed down within the newly formed concrete slab and surrounding concrete moves over the dowel bars 114 so that the dowel bars 114 are eventually enveloped by the surrounding concrete.

FIG. 9 shows the DBI 101 at a point during the fourth stage. During this stage, the beam 104 and the forks 118 are both raised. In this embodiment, the beam 104 and the forks 118 are raised to approximately the same height as their initial position shown in FIG. 2.

Figure 10:
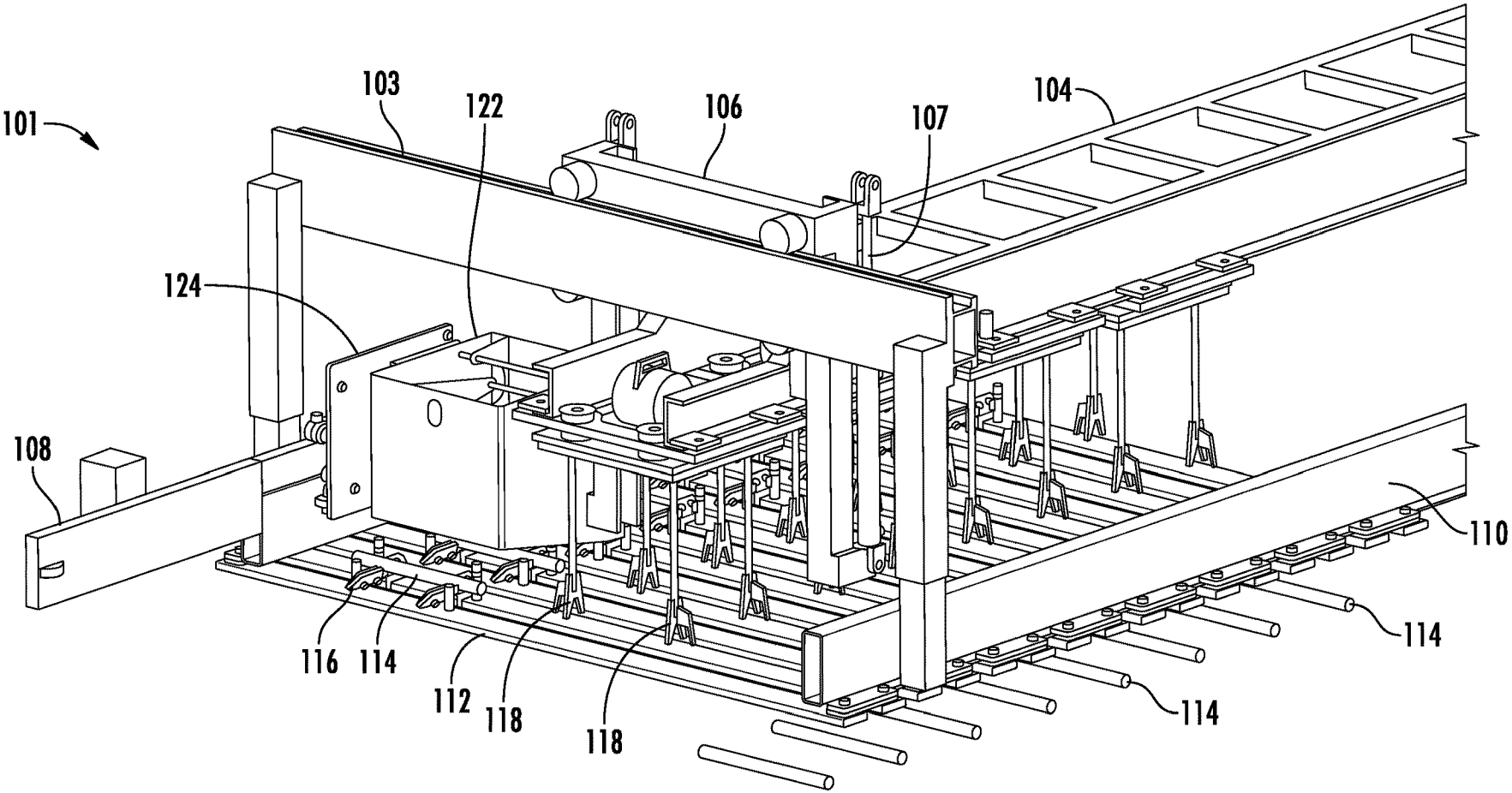
FIG. 10 is an isometric view of the dowel bar inserter mechanism of FIG. 2 where the loading cart is inserting new dowel bars into the bar holders.
Figure 11:
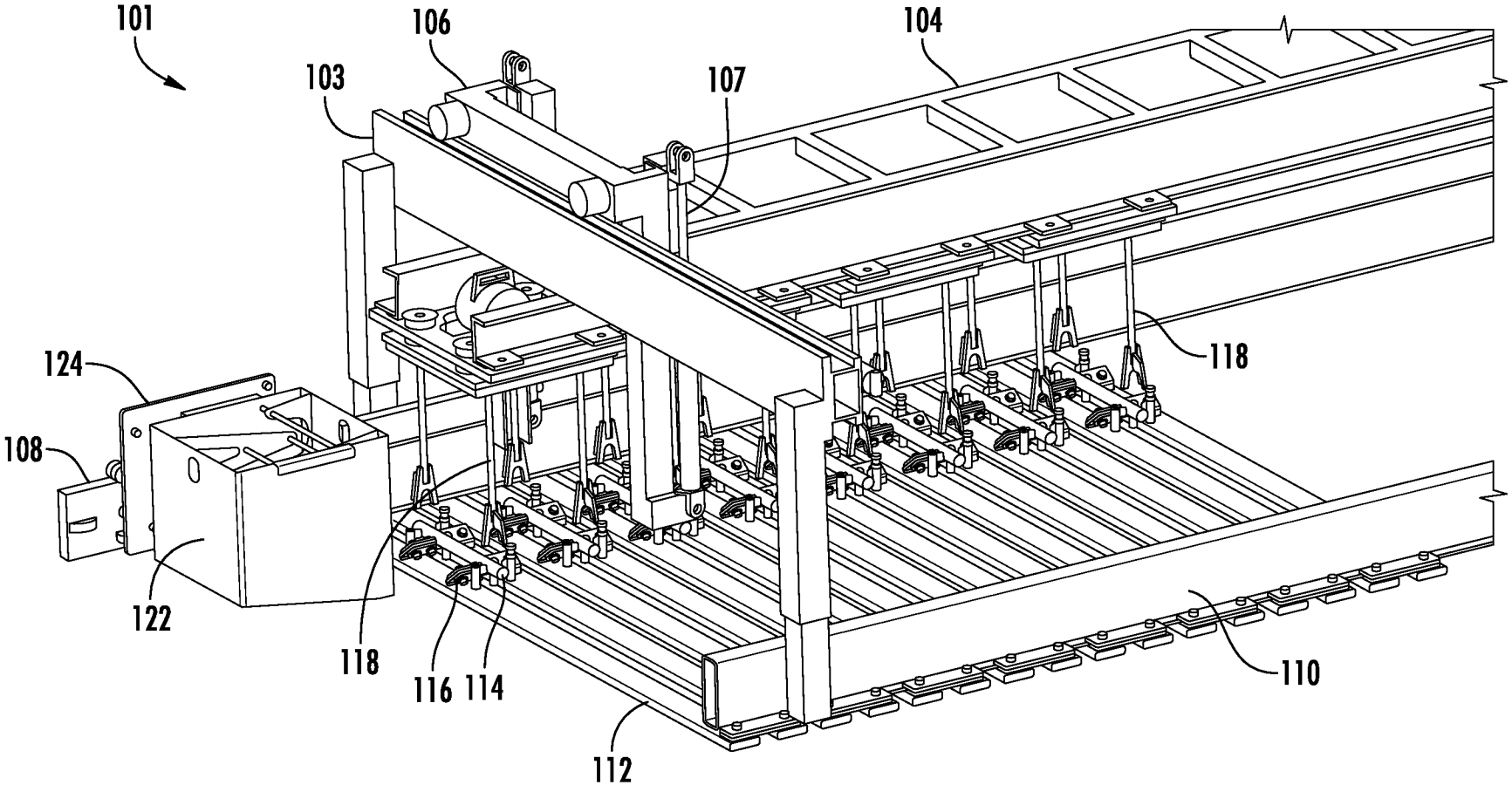
FIG. 11 is an isometric view of the dowel bar inserter mechanism of FIG. 2 where the system is reset to begin another cycle.

FIG. 10 shows the DBI 101 at a point during the fifth stage. At this stage, the loading cart 122 travels transversely across the width of the DBI 101. The loading cart 122 travels over the bar holders 116 and places dowel bars 114 into some or all of the bar holders 116. After the dowel bars 114 have been placed, the loading cart 122 may be returned to its original position. In the embodiment shown in FIG. 10, the loading cart 122 is physically connected to a sliding bracket 124. This sliding bracket 124 is allowed to slide along the front railing 108. In the embodiment shown in FIG. 10, the carrier 106, the beam 104, and the forks 118 are moving in the forward direction. However, in other embodiments, these components will not move in the forward direction until the loading cart 122 has placed dowel bars 114 and returned to its original position shown in FIG. 2.

After the loading cart 122 has returned to its original position, the carrier 106, the beam 104, and the forks 118 move in the forward direction. These components ultimately reach their forward position shown in FIG. 11. At this point the cycle has been completed, and a new cycle may begin proceeding through the stages discussed above.

Various motors, linear actuators, or other components may be used to provide the necessary power to move the components as described above. A person of ordinary skill in the art would appreciate that a variety of components could be used to provide the necessary power. The DBI 101 may obtain power from the paving machine 100 or the DBI 101 may possess its own, independent power source.

Figure 12:
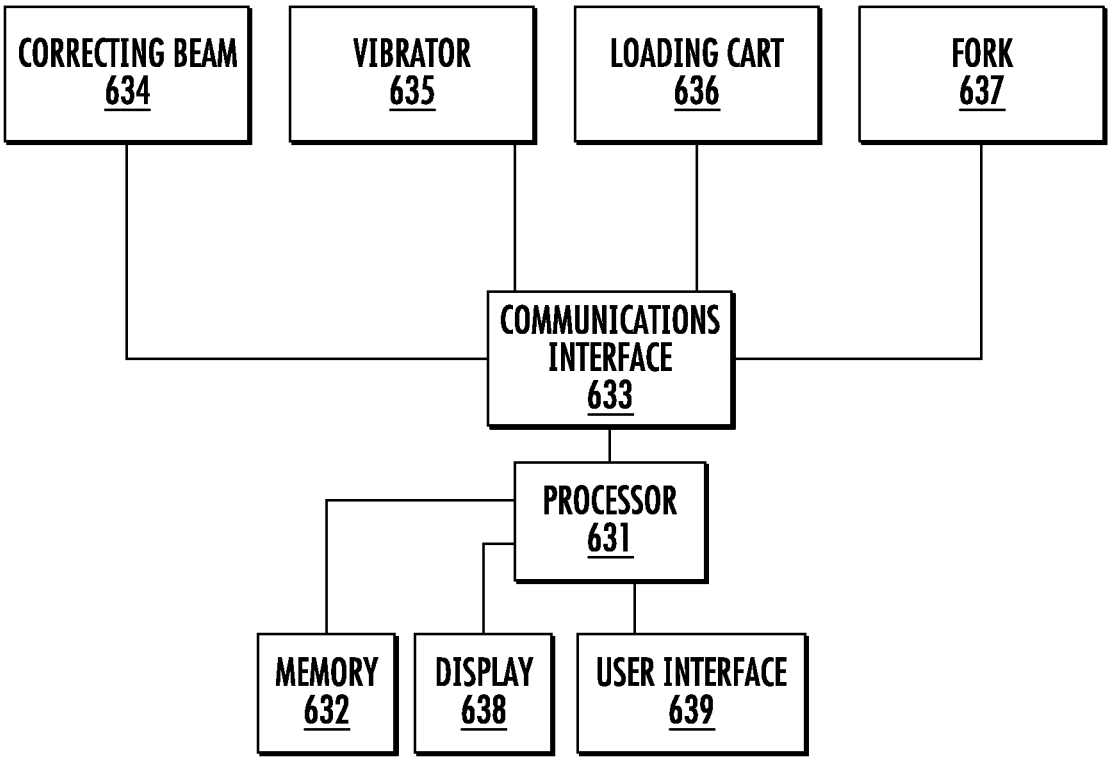
FIG. 12 is a block diagram illustrating various electronic components within an example device in accordance with an embodiment of the present invention.

FIG. 12 illustrates a block diagram with various electronic components within an example device. The device may include a correcting beam 634, a vibrator 635, a loading cart 636, and one or more forks 637. Each of these components may have an actuator, a servomotor, or some other similar device to permit movement of the component relative to other components of the DBI 101 (see FIG. 2).

A processor 631 and memory 632 may be provided, and the processor 631 may be connected to the correcting beam 634, the vibrator 635, the loading cart 636, and the fork 637 via a communications interface 633. The processor may also be connected to a display 638 and a user interface 639. At the display 638, information may be provided to a user about the status of the device. At the user interface 639, commands may be received from a user to alter the operation of the device. For example, the depth at which dowel bars 114 (see FIG. 2) are laid may be adjusted, the locations where dowel bars 114 are placed by the loading cart 636 may be adjusted, or the intensity of vibration at the vibrator 635 may be adjusted.

The memory 632 may include computer program code. The memory 632 and the computer program code may be configured to, with the processor 631, cause the device to perform certain tasks. These tasks include, but are not limited to, causing dowel bars 114 (see FIG. 2) to be positioned on bar holders 116 (see FIG. 2), causing one or more forks 118 (see FIG. 2) to shift downwardly to push the dowel bars 114 through the one or more bar holders 116, and causing one or more forks 118 to shift downwardly to push the dowel bars 114 downwardly into the newly formed concrete slab. The tasks may also include causing the loading cart 122 (see FIG. 2) to shift along the transverse direction of the DBI 101 (see FIG. 2) and causing the loading cart 122 to deposit a dowel bar 114 at a location associated with a bar holder 116, receiving an indication that the forks 118 have been lowered to a desired depth, causing the forks 118 to be raised above the surface of the newly formed concrete slab, and causing the forks 118 to shift in the forward direction.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements.

What is claimed is:

1. A device for inserting dowel bars, the device comprising:

at least one floor plate, wherein the at least one floor plate defines a slot;

one or more bar holders, the one or more bar holders positioned above the slot defined within the at least one floor plate, wherein the one or more bar holders are capable of holding a dowel bar, wherein the one or more bar holders are capable of allowing the dowel bar to move through the slot defined within the at least one floor plate when the dowel bar is pushed; and at least one fork that is capable of moving longitudinally with respect to the at least one floor plate, wherein the device is configured to move in a forward direction over a newly formed concrete slab, wherein the fork is capable of being lowered to push a dowel bar downward into the newly formed concrete slab, and wherein the at least one floor plate moves forward at a same pace as the device and the device is configured to move continuously in the forward direction.

2. The device according to claim 1, wherein the at least one floor plate is configured to remain in constant contact with the newly formed concrete slab.

3. The device according to claim 1, further comprising:

a correcting beam, wherein the correcting beam is positioned behind the at least one floor plate so that the correcting beam travels over a newly formed concrete slab after the at least one floor plate as the device moves in the forward direction.

4. The device according to claim 3, wherein the correcting beam is configured to oscillate back and forth in a direction transverse to the forward direction.

5. The device according to claim 1, further comprising a vibrator, wherein the vibrator is configured to cause vibration of the at least one floor plate and the newly formed concrete slab below the at least one floor plate.

6. The device according to claim 1, further comprising a loading cart that is configured to store one or more dowel bars, wherein the loading cart is configured to shift along the transverse direction of the device, and wherein the loading cart is configured to deposit a first dowel bar of the one or more dowel bars on a first bar holder of the one or more bar holders.

7. The device according to claim 6, wherein the loading cart is configured to shift along the transverse direction of the device while the device is moving in the forward direction.

8. The device according to claim 1, wherein the slots are greater than 1.25 inches wide.

9. The device according to claim 8, wherein the slots are less than 1.5 inches wide.

10. The device according to claim 9, wherein the slots are less than 1.3 inches wide.

11. The device according to claim 10, wherein the slots are less than 1.26 inches wide.

12. The device according to claim 1, wherein the one or more bar holders comprise a resilient member that is configured to assist in holding the dowel bar, wherein the resilient member is configured to adopt a distorted shape upon the application of a certain force to the resilient member.

13. The device according to claim 1, further comprising a processor and a memory including computer program code, the memory and the computer program code configured to, with the processor, cause the device to:

cause the one or more dowel bars to be positioned on the one or more bar holders;

cause one or more forks to shift downwardly to push the dowel bars through the one or more bar holders; and cause one or more forks to shift downwardly to push the dowel bars downwardly into the newly formed concrete slab.

14. The device according to claim 13, further comprising a loading cart that is configured to store one or more dowel bars, wherein the loading cart is configured to shift along the transverse direction of the device, and wherein the loading cart is configured to deposit a first dowel bar of the one or more dowel bars on a first bar holder of the one or more bar holders, wherein the memory and the computer program code configured to, with the processor, to:

cause the loading cart to shift along the transverse direction of the device; and cause the loading cart to deposit the first dowel bar at a location associated with a first bar holder.

15. The device according to claim 13, wherein the memory and the computer program code configured to, with the processor, to:

receive an indication that the forks have been lowered to a desired depth;

cause the forks to be raised above the surface of the newly formed concrete slab; and cause the forks to shift in the forward direction.

* * * * *